United States Patent [19]

Yano et al.

[11] Patent Number: 4,480,799

[45] Date of Patent: Nov. 6, 1984

[54] APPARATUS FOR CONTROLLING TENSION APPLIED ONTO AN ELECTRIC WIRE IN A WINDING MACHINE

[75] Inventors: Kiyoshi Yano; Yukinori Taneda, both of Yokohama; Takashi Kobayashi, Fujisawa, all of Japan

[73] Assignee: Hitachi, Ltd., Tokyo, Japan

[21] Appl. No.: 101,271

[22] Filed: Dec. 7, 1979

[30] Foreign Application Priority Data

Dec. 22, 1978 [JP] Japan ..... 53-157474

[51] Int. Cl.[3] ..... B65H 54/04; B65H 59/38

[52] U.S. Cl. ..... 242/25 R; 242/45; 242/158 R

[58] Field of Search ..... 242/25 R, 25 A, 7.13, 242/158 R, 158.2, 158.4 R, 45, 43 R

[56] References Cited

U.S. PATENT DOCUMENTS

| | | | |
|---|---|---|---|
| 2,947,487 | 8/1960 | Winestock | 242/7.13 X |
| 3,606,183 | 9/1971 | Turk | 242/25 R X |
| 3,677,483 | 7/1972 | Henrich | 242/25 R |
| 3,967,787 | 7/1976 | Mulleman | 242/25 R |
| 4,004,744 | 1/1977 | Hoorelbeke | 242/25 R |
| 4,022,391 | 5/1977 | Stein et al. | 242/25 R |
| 4,076,055 | 2/1978 | Zolman et al. | 242/7.15 X |

*Primary Examiner*—Stanley N. Gilreath
*Attorney, Agent, or Firm*—Antonelli, Terry & Wands

[57] ABSTRACT

A tension control apparatus in a winding machine for controlling tension applied to a continuous electric wire wound around a bobbin to form a perfect layer coil in such manner that tension of the electric wire is maintained substantially constant independently from variations in a feeding speed of the wire. Rotating positions of the bobbin preceding to those rotating positions by a magnitude corresponding to a time constant of brake means at which the rotation of the bobbin is to be changed among an accelerating rotation mode, a decelerating rotation mode and a constant speed rotation mode are preset in control means together with brake voltages corresponding, respectively, to the rotation modes through programming. The programmed rotating positions are each compared with a detection signal produced from detecting means for detecting actual rotating position of the bobbin. Upon occurrence of coincidence between the two rotating positions, a brake voltage corresponding to the succeeding rotation mode is applied to the brake means, whereby an appropriate braking force is produced upon transition to the succeeding rotation mode thereby to maintain the tension of the electric wire to be substantially constant.

5 Claims, 8 Drawing Figures

APPARATUS FOR CONTROLLING TENSION APPLIED ONTO AN ELECTRIC WIRE IN A WINDING MACHINE

BACKGROUND OF THE INVENTION

1. Field of the Invention

The present invention relates in general to a winding machine for winding an electric wire around a winding bobbin to form a perfect layer coil. In particular, the invention concerns a tension control apparatus for controlling tension applied to the electric wire being fed to the winding bobbin so that the tension remains substantially constant independently of variation of the tension produced in one rotation of the winding bobbin or variation in the rotating speed of the winding bobbin.

2. Description of the Prior Art

For forming a perfect layer coil by winding a continuous electric wire around a winding bobbin of a circular cross-section, it becomes necessary to carry or step up the wire being wound to a next outer layer position at both ends of the winding bobbin successively thereby to coordinate the superposed positions of the electric wire in the individual winding layers. To this end, the rotating speed of the bobbin is decelerated when the winding position of the wire reaches one or several turns short of either one end of the bobbin, and the winding position is stepped up to the next upper layer position. Then, after winding of the wire for a single or several turns, the rotation speed of the bobbin is again accelerated to a predetermined constant speed. As the consequence of the deceleration of the rotating speed of the bobbin effected when the winding position of the wire is stepped up to the next outer winding layer, there is produced a reduction in tension applied to the wire and eventually a sag, because the wire fed out from a supply reel at a high speed before the deceleration will tend to remain at the same speed due to inertia of the wire portion spanned between the bobbin and the supply reel as well as inertia of pulleys for guiding the electric wire, i.e. the wire is fed out from the supply reel in a larger quantity than the wire is wound around the bobbin. On the other hand, upon acceleration of the winding bobbin, tension on the spanned wire will be abruptly increased due to a drawing force exerted to the wire for accelerating the feeding speed thereof.

In the case of the winding machine in which a bobbin having a winding portion of a rectangular cross-section is employed, tension applied to the electric wire undergoes rapid variation every time the winding position of the electric wire moves over a corner of the rectangular bobbin during every revolution of the bobbin in addition to variations occurring at both ends of the bobbin.

In the winding of a perfect layer coil, the rapid variations in the tension of the wire will involve deterioration in the wire alignment among the turns of coil wound on a bobbin. More specifically, an abrupt or rapid reduction in the tension applied to the wire will result in generation of slack or a sag, making it difficult to wind the electric wire correctly on or along the wire already wound around the bobbin. On the other hand, an abrupt or rapid increase in the tension of the wire will result in the wire being undesirably stretched to give rise to variation in the resistance value of the wire for a unit length, delamination of a coated insulation layer and possibly breakage of the wire in the worst case.

As will be appreciated from the above discussion, variation in the tension of the electric wire being fed during the winding operation to form a coil will bring about various problems, it is desirable that the tension of the wire should be maintained as constant as possible regardless of variation of the tension produced in one rotation of the bobbin or variation rotating speed of the winding bobbin.

As an attempt to overcome the difficulties described above, there has been heretofore proposed a tension control apparatus which is composed of a brake reel around which a continuous electric wire as drawn from a supply reel is wound for a desired number of turns to thereby apply a tension to the wire, brake means for applying to the brake reel a braking force corresponding to an input brake voltage, tension adjusting means including a roller rotatably supported on a pivotally mounted arm so as to be positioned between the brake reel and the winding bobbin, which roller serves to engage the wire in such manner that the arm is swung by following variation in the tension of the wire being fed to the winding bobbin to thereby absorb variations in the tension of wire, and a differential amplifier circuit for producing the brake voltage in dependence on the swinging magnitude of the arm, whereby the tension of the wire is controlled as a function of the swinging movement of the arm.

The prior art tension control apparatus mentioned above is disadvantageous in that the controlling operation is effected only with a delay, rendering it impossible to maintain the tension constant, since there is involved a large amount of time delay between occurrence of variation in the tension of the wire and the application of the braking force to the brake reel due to the fact the arm is first swung in response to variation in the tension of the wire to actuate the differential amplifier for deriving a requisite brake voltage which is then applied to the brake means to be subsequently converted into a corresponding braking force to be applied to the brake reel. Particularly when a coil of a rectangular cross-section is formed at a high speed, the tension controlling apparatus can not follow rapid variations in the tension of the wire with reasonable reliability. Besides, since the swinging amplitude of the sensing arm becomes increased as variation in the tension becomes more remarkable, a relatively long time is required for the tension of the wire to become stabilized because of generation of attenuating oscillation of the arm. Further, when tension of the wire undergoes successive variations with short period, resonance oscillation will take place to eventually lead to the breakage of the wire.

SUMMARY OF THE INVENTION

An object of the invention is to provide a tension control apparatus for a winding machine which is capable of controlling tension applied to an electric wire fed to a winding bobbin to be constant regardless of rapid deceleration and acceleration in the rotating speed of the bobbin thereby to assure fabrication of a coil wound in a satisfactorily coordinated state at a high speed.

Another object of the invention is to provide a tension control apparatus for a winding machine which is capable of suppressing periodical variation in tension produced in an electric wire fed to a winding bobbin of a rectangular cross-section during a single revolution of the bobbin thereby to assure formation of a coil wound in a satisfactorily coordinated state at an enhanced speed.

In view of the above objects, it is proposed according to an aspect of the invention that control means is provided for determining rotational positions of the bobbin preceding, respectively, those rotational positions by a magnitude corresponding to a time constant of the electromagnetic brake (time span between application of the brake voltage and generation of the braking force) at which positions rotating speed of the bobbin is to be changed over among an accelerating rotation mode, decelerating rotation mode and a constant-speed rotation mode and setting brake voltages corresponding to the above rotation modes through programming, wherein upon every occurrence of coincidence between the rotating position of the bobbin detected by detecting means for detecting the rotating position of the bobbin and the programmed rotating position, the brake voltage corresponding to the succeeding rotation mode to be next established is applied to the brake means thereby to produce a braking force corresponding to the succeeding rotation mode simultaneously with transition to that mode, whereby tension applied to the electric wire is controlled to be substantially constant during the winding operation.

According to another aspect of the present invention, it is further proposed that there is provided in addition to the control means described above a second control means for determining rotating positions of the bobbin which precede those rotating positions by a magnitude corresponding to the time constant of the electromagnetic brake at which variations in tension applied to the electric wire occur during a single revolution of the bobbin and setting brake voltages corresponding, respectively, to the variations in tension of the electric wire during the single revolution of said bobbin through programming, wherein upon every detection of coincidence between the actual rotating position of the bobbin detected by the detecting means and the programmed rotating position set by the first controller, the brake voltage corresponding to the succeeding rotation mode to be next established its produced as a source voltage, and upon occurrence of coincidence between the actual rotating position detected by the detecting means and the programmed rotating position set by the second controller, the brake voltage corresponding to the relevant variation in tension of the electric wire is derived from the source voltage and applied to the electromagnetic brake, whereby braking forces corresponding, respectively, to the rotation modes and the variation in tension of the electric wire occurring during the single revolution of the bobbin are produced to control the tension of the electric wire to be substantially constant.

According to a further aspect of the invention, there is provided pretensioning means disposed between the supply source reel for the electric wire and the brake means for applying additionally a tension to the electric wire to thereby prevent slip from occurring between the electric wire and the brake reel due to variation in a feeding speed of the electric wire.

DETAILED DESCRIPTION OF THE PREFERRED EMBODIMENTS

Now, the invention will be described in detail in conjunction with the exemplary embodiments illustrated in the accompanying drawings.

Figure 1:
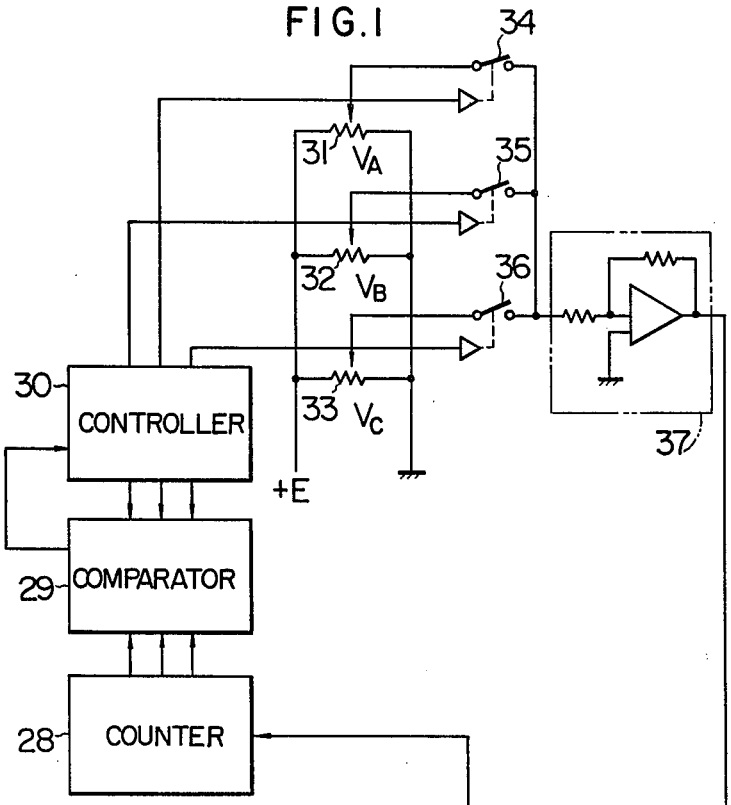
FIG. 1 is a block diagram to show an arrangement of a tension control apparatus for a coil-winding machine according to an embodiment of the invention.
Figure 2:
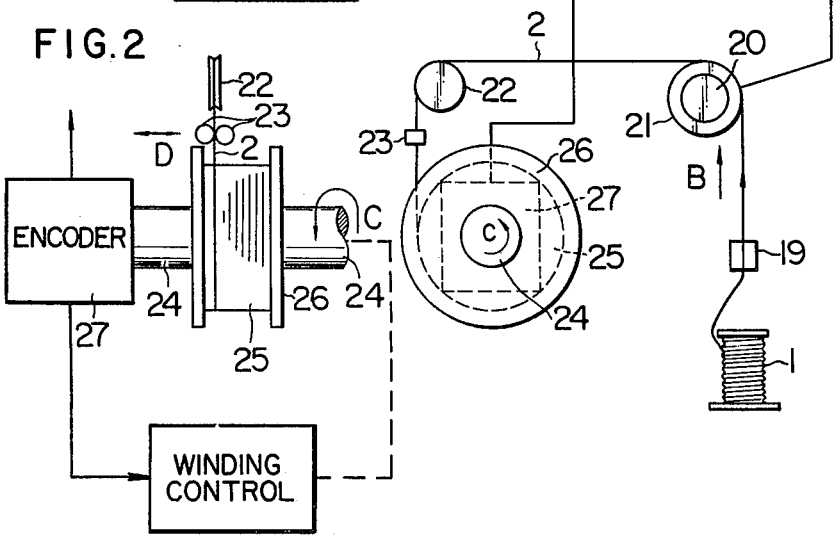
FIG. 2 is a side view showing a portion of the apparatus shown in FIG. 1.
Figure 3:
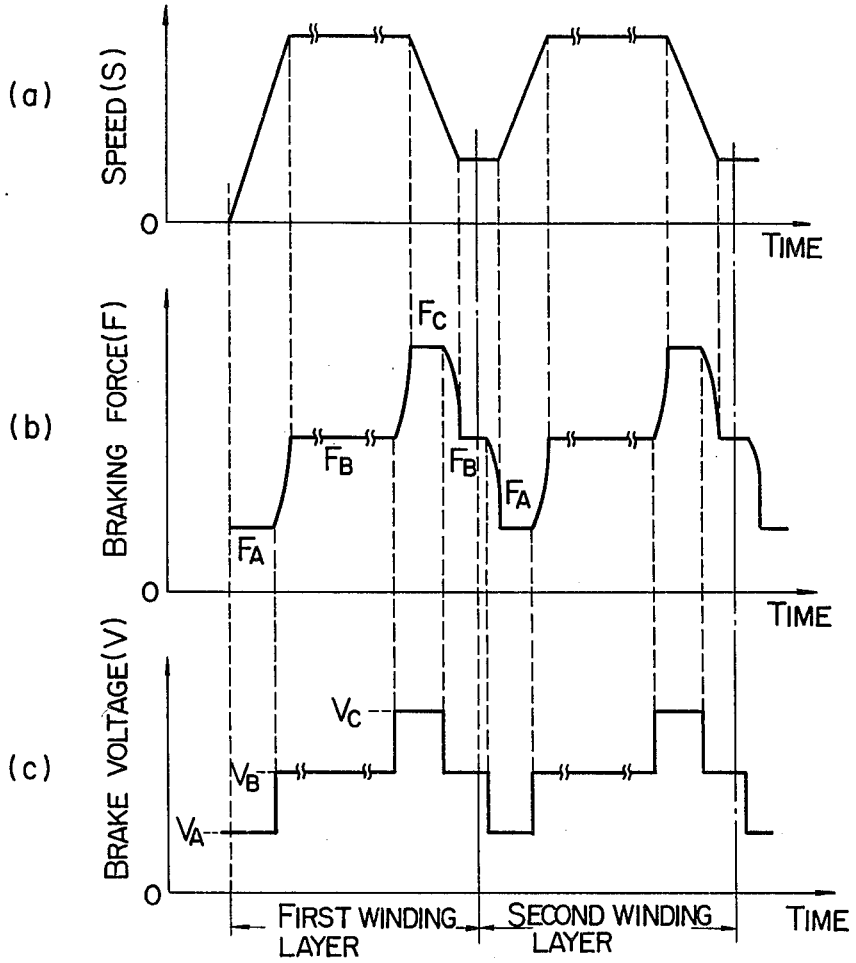
FIG. 3 is a signal waveform diagram to illustrate relationships among variations in the feeding speed of an electric wire, braking forces exerted to the wire in correspondence with variations in the feeding speed thereof and brake voltages required for producing the controlled braking forces in a winding operation.

Referring to FIGS. 1 to 4 which shows a tension control apparatus for a winding machine according to a first embodiment of the invention, an electric wire 2 dispensed from a wire supply reel 1 is applied with a predetermined tension by a pretension or pre-tightening apparatus 19 and then wound around a brake reel 21 for a predetermined number of turns to be set to a predetermined tensioned state required for being wound in a coil. The brake reel 21 is applied with a braking force by an electromagnetic brake 20. The electric wire 2 drawn out from the brake reel 21 is fed through a guide reel 22 and a pair of positioning rollers 23 for wire traverse and wound around a winding bobbin 26 rotatably supported on a winding shaft 24. The magnitude of tension applied to the electric wire 2 by the pretension apparatus should preferably be set to a possible minimum value which however must be sufficiently large to assure that no sag is produced in the electric wire 2 along the path extending between the supply reel 1 and the winding bobbin 26 and that no slip of the wire 2 occurs relative to the brake reel 21 by correspondingly controlling the tension of the wire 1 during the winding operation. The positioning rollers 23 are operated in synchronism with the rotation of the winding bobbin 26 so as to be moved reciprocatably in the direction parallel to the center axis of the winding bobbin 26, whereby the feeding position of the wire 2 relative to the winding bobbin 26 is also axially displaced to assure a perfect winding of the wire 2. Mounted on the winding shaft 24 at one end thereof is a rotary encoder 27 which is adapted to produce a train of pulses with pulse intervals proportional to the rotating speed of the winding shaft 24. The output pulse train from the rotary encoder 27 is supplied to a bobbin winding control 10 coupled to the winding shaft 24 and to a counter 28 which serves to count the pulses from the encoder 27 thereby to detect the instantaneous rotation angle of the winding bobbin 26. The winding control 10 operates the bobbin 26 in accordance with the waveform of FIG. 3(*a*), for example, based upon the output of the encoder 27. The output of the counter 28 is coupled to a comparator 29 which in turn is connected to a control unit 30. There are preset in the controller 30 various data of brake voltages to be changed in dependence on the revolution number of the winding bobbin 26 in consideration of the time constant (lag in operation) of the electromagnetic brake 20. For example, there are stored a brake voltage to be applied to the electromagnetic brake 20 before the initiation of rotation of the winding bobbin 26, a value representing the rotating speed or revolution number of the winding bobbin at the time point immediately preceding to acceleration of the bobbin after the initiation of rotation thereof and a corresponding brake voltage to be applied to the electromagnetic brake 20, a value representing the rotating speed of the winding bobbin 26 immediately before the transition from the accelerating mode to a constant-speed rotation at a high speed and a corresponding brake voltage to be applied to the electromagnetic brake 20, a value representing the rotating speed of the winding bobbin 26 immediately before the transition from the constant-speed rotation to deceleration and a brake voltage corresponding to the deceleration mode, a value representing the rotating speed of the winding bobbin 26 immediately before the transition from the decelerating mode to a constant-speed rotation mode at a low speed and a brake voltage corresponding to the low-speed constant rotation, a value representing the number of turns of the wire 2 to be wound around the winding bobbin 26 in a single layer, and a value representing the total number of turns of the wire 2 to be wound around the winding bobbin 26 to constitute a completed coil 25. The comparator 29 is successively supplied with the preset values described above in a predetermined sequence from controller 30. When coincidence occurs between the current value set in the comparator 29 and the counted value applied from the counter 28, a command signal for changing the brake voltage applied to the electromagnetic brake 20 is fed from the comparator 29 to the controller 30. In the case of the embodiment now being described, the controller 30 is provided with three output terminals which are, respectively, connected to switches 34, 35 and 36 having respective movable contacts which in turn are connected to variable resistors 31, 32 and 33 for setting voltages $V_A$, $V_B$ and $V_C$, respectively. In accordance with the brake voltage changing command issued from the comparator 29, the controller 30 closes selectively one of the switches 34, 35 and 36 to derive a requisite brake voltage $V_A$, $V_B$ or $V_C$. The brake voltage thus derived through the closing of the selected switch 34, 35 or 36 is applied to the electromagnetic brake 20 after having been amplified through a differential amplifier 37. The electromagnetic brake 20 in its turn produces a braking force corresponding to the applied brake voltage to apply a requisite tension to the electric wire 2 through the brake reel 21. The controller 30 may be constituted by a microcomputer adapted to perform control operation in accordance with a program illustrated in a flow chart of FIG. 4 for controlling the brake voltage V so that the braking force F is exerted onto the wire 2 moving at a linear speed S in such manner as illustrated in FIG. 3.

In operation of the winding machine provided with the tension control apparatus of the arrangement described above, the winding bobbin 26 is at first mounted fixedly on the winding shaft 24 and then the free end portion of the electric wire 2 threaded out from the paired positioning rollers 23 is secured to the winding bobbin 26 or the winding shaft 24 at a predetermined location. On the other hand, the data of various values representing the brake voltage V to be applied to the electromagnetic brake 20, the timing for changing over the brake voltages, the number of turns for a single layer, the total number of turns and the like as described hereinbefore are placed at the controller 30. After the initialization, the controller 30 is started to close the switch 34,, whereby the brake voltage $V_A$ is applied to the electromagnetic brake 20. Starting from the current state, the winding shaft 24 is rotated by a drive motor (not shown) of the winding control 10 while the paired positioning rollers 23 are moved in the direction parallel to the axis of the winding bobbin 26 in synchronism with the rotation thereof. When the winding bobbin 26 has been driven for a substantially complete revolution from the start of winding, the winding bobbin 26 is rapidly accelerated to a preset number of revolution. Accordingly, the brake voltage $V_A$ applied to the electromagnetic brake 20 through the closing of the switch 34 corresponds to the brake voltage adjusted for the acceleration. Since the braking force produced by the electromagnetic brake 20 in the accelerating mode is of a very small magnitude, the wire 2 being fed will not be subjected to an increasing tension, even though the linear speed of the wire 2 going to be wound around the winding bobbin is increased. At this time point, the value representing the rotating speed of the winding bobbin 26 immediately before the transition from the accelerating mode to the constant-speed rotation mode is set at the comparator 29. On the other hand, pulses are produced from the rotary encoder 27 mounted on the winding shaft 24 in synchronized timing with the rotation of the winding bobbin 26 and counted by the counter 28. When the counted value of the counter 28 coincides with the value set at the comparator 29 from the controller 30, a command signal for changing the brake voltages is produced by the comparator 29 and supplied to the controller 30. In response to the command signal, the controller 30 opens the switch 34 and simultaneously closes the switch 35, as the result of which the brake voltage $V_B$ is now applied to the electromagnetic brake 20. At this time point, the value representing the speed of the winding bobbin immediately before the transition from the constant-speed rotation mode to the deceleration mode as described hereinbefore is loaded to the comparator 29. Simultaneously with the transition of the winding bobbin 26 to the constant-speed rotation mode, the braking force $F_A$ exerted heretofore by the electromagnetic brake 20 is changed over to a braking force $F_B$, whereby the electric wire 2 is placed under tension of a magnitude required for the electric wire 2 to be wound around the bobbin 26 at the constant rotating speed. With the constant-speed rotation of the winding bobbin 26, the first winding layer is formed. When the first layer is formed to a location in the vicinity of the termination thereof, the count value in the counter 28 will coincide with the value set at the comparator 29, as the result of which a command for changing the brake voltage is again produced from the comparator 29 to the controller 30. In response to the new command, the controller 30 opens the switch 35 and simultaneously closes the switch 36, whereby a brake voltage $V_C$ is now applied to the electromagnetic brake 20. At the same time, the value representing the rotation speed of the winding bobbin 26 immediately before the transition of the decelerating mode to the constant-speed rotation mode is placed in the comparator 29. Simultaneously with the beginning of the deceleration of the rotating winding bobbin 26, the electromagnetic brake 20 will produce a braking force $F_C$ corresponding to the applied brake voltage $V_C$ to thereby decelerate the rotation of the brake reel 21. Under the circumstance, since the feeding speed of the electric wire 2 supplied to the winding bobbin 26 is reduced in correspondence with the lowered rotating speed of the bobbin 26, there arises no sag in the electric wire being fed. In this manner, the rotation speed of the winding bobbin 26 can be lowered toward a predetermined low level while maintaining the electric wire 2 being fed under a predetermined tension. Immediately before the rotating speed of the winding bobbin has attained the predetermined low level described above, the count value in the counter 28 will coincide with the value set at the comparator 29, resulting in that a command signal for changing the brake voltage is issued from the comparator 29 to the controller 30. In response to the command signal, the controller 30 opens the switch 36 and simultaneously closes the switch 35, whereby the braking force $V_B$ is applied to the electromagnetic brake 20. At this time point, the value representing the rotation speed of the winding bobbin 26 immediately preceding to the transition from the constant-speed rotation mode to the accelerating mode is loaded to the comparator 29. Simultaneously with the transition of the winding bobbin 26 to the constant-speed rotation mode of a low speed, the braking force $F_C$ of the electromagnetic brake is changed over to the braking force $F_B$. In this state, the winding operation for the first winding layer comes to an end, whereupon the winding position of the electric wire 2 is displaced in the axial direction relative to the bobbin 26 from the termination of the first winding layer to a stepped-up beginning position for a second winding layer. Thereafter, upon rotation of the winding bobbin 26 for a predetermined angle, the counted value of the counter 28 will coincide with the value set in the comparator 29 which will then produce a command signal for changing the brake voltage to the controller 30. In response thereto, the controller 30 opens the switch 35 while closing simultaneously the switch 34, as the result of which the brake voltage $V_A$ is applied to the electromagnetic brake 20. At this time point, the value representing a rotation speed of the winding bobbin 26 immediately before the transition from the accelerating mode to the constant-speed rotation mode is set at the comparator 29. Simultaneously with the acceleration of the rotating bobbin 26, the braking force $F_B$ heretofore exerted by the electromagnetic brake 20 is replaced by the braking force $F_A$, to thereby facilitate rotation of the brake reel 21. Thus, the electric wire is fed at an increased speed while being maintained constantly under the predetermined tension. In the similar manner, the winding of the wire 2 is effected for a required number of turns.

In this manner, by controlling the braking force exerted to the brake reel 21 in dependence on variation in the rotating speed of the winding bobbin to thereby prevent the tension applied to the running wire from being varied, it is possible to maintain the tension of the wire 2 constant at all times and thus produce the coil 25 in a properly aligned or perfect layer state.

FIGS. 5 to 8 illustrate a winding machine provided with a tension control apparatus according to another embodiment of the invention. In the case of this embodiment, the winding machine is adapted to wind an electric wire around a bobbin 17 having a rectangular or square form in cross-section. In the figures, the parts or elements performing the same or similar functions as those shown in FIGS. 1 to 4 are denoted by the same reference numerals. The bobbin 17 for forming a coil 16 of a rectangular cross-section is fittingly mounted on a winding drum 14 formed on a winding shaft 14 and fixedly secured by means of a nut 15. The winding shaft 24 is driven by an electric motor (not shown) through a belt 18 at controlled speeds in a manner described hereinafter. Mounted also on the winding shaft 24 at one end thereof is the rotary encoded 27 adapted to produce a train of pulses which is supplied counters 28 and 38 to be counted. The output of the counter 38 is coupled to a comparator 39 which in turn is connected to a control unit or controller 40. There are preset in the controller 40 data of timing for changing over the brake voltages in dependence on rotation angle of the winding bobbin 17 during a single complete revolution thereof. The comparator 39 is successively supplied with the preset timing data from controller 40 to be compared with the instantaneous count value in the counter 38 for determining the timing or time points at which the brake voltages are to be actually changed over. For deriving required brake voltages from the source voltage, there are provided variable resistors 31, 32 and 33 having respective movable tap terminals to which switched 34, 35 and 36 are connected. With a view to setting voltages in a narrower range to set brake voltages for controlling the tension exerted on the wire 2 thereby to accommodate variations in the linear speed of the electric wire being feed during every single complete revolution of the bobbin 17, resistors 41, 42, 43, 44 and 45 are connected to an output terminal common to the switches 34, 35 and 36. The resistors 41, 42, 43 and 45 are also constituted by variable resistors having respective movable taps to which switches 46, 47, 48, 49 and 50 are connected respectively and adapted to be opened and closed in accordance with commands issued from the controller 40. The voltage selectively derived through the switch 46, 47, 48, 49 or 50 is applied to an electromagnetic brake 20 through a differential amplifier 37. The controller 40 is coupled to the controller 30 so as to be operated in synchronism with the latter.

Figure 7:
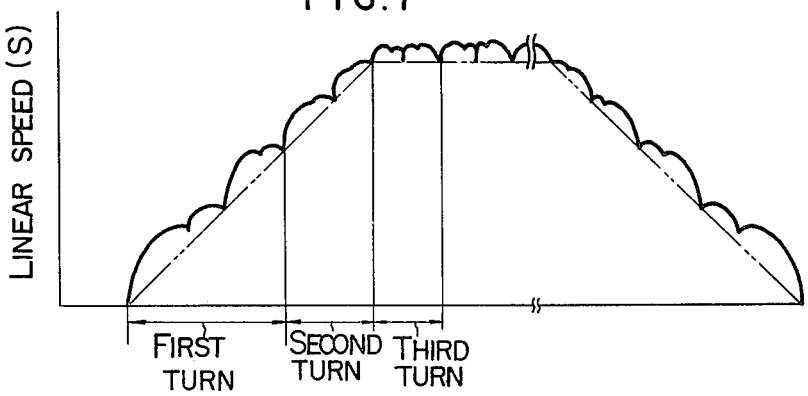
FIG. 7 is a waveform diagram to illustrate variations in the feeding speed of an electric wire in a winding operation to form a coil of a rectangular cross-section.
Figure 4:
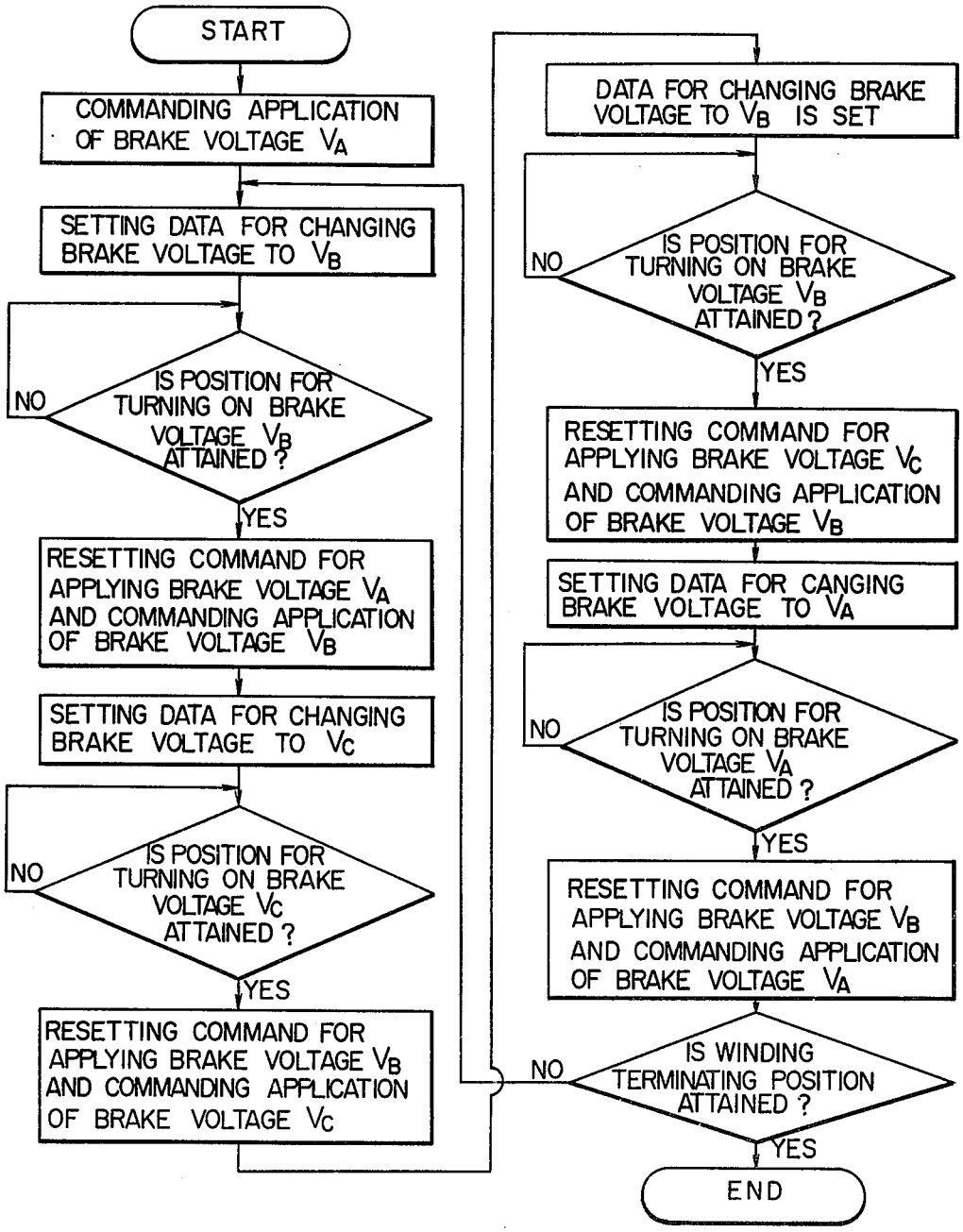
FIG. 4 is a flow chart to illustrate a program for a control process to be executed by the controlling apparatus shown in FIG. 1.
Figure 5:
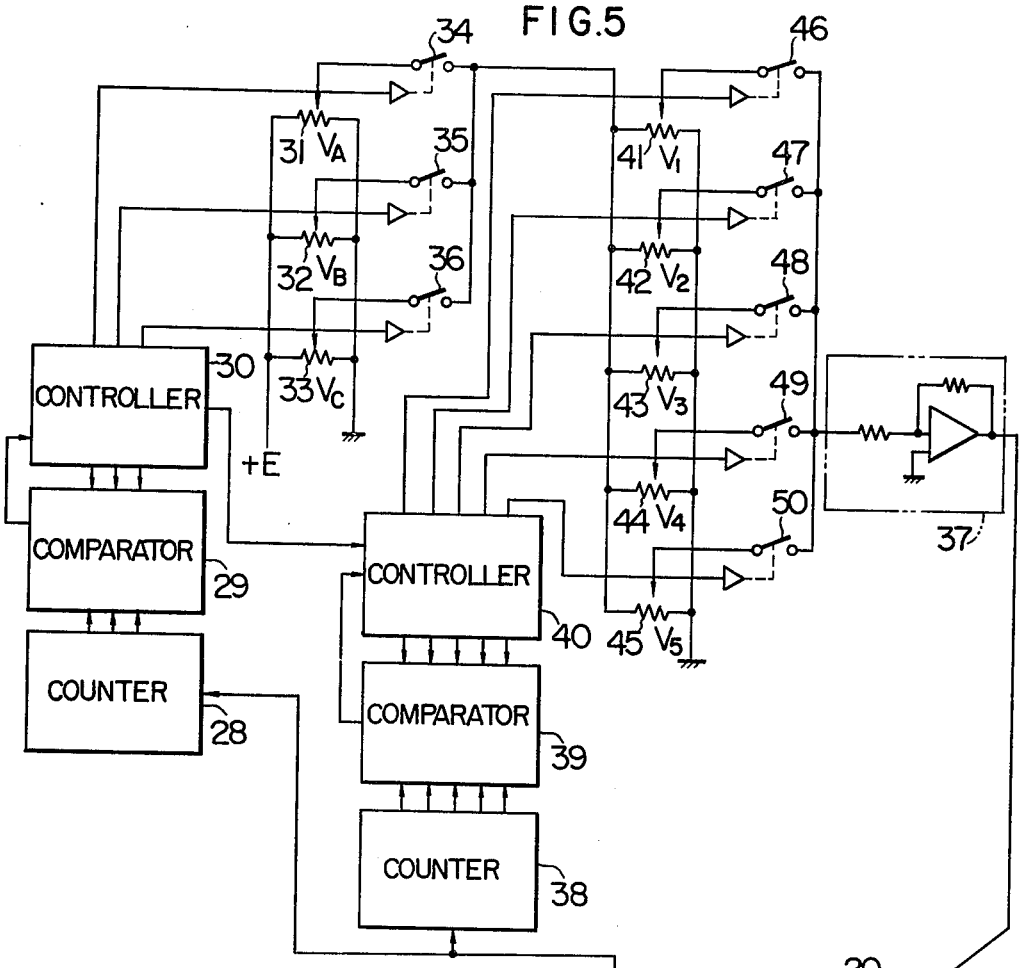
FIG. 5 is a block diagram to show a general arrangement of a tension control apparatus according to a second embodiment of the invention.
Figure 6:
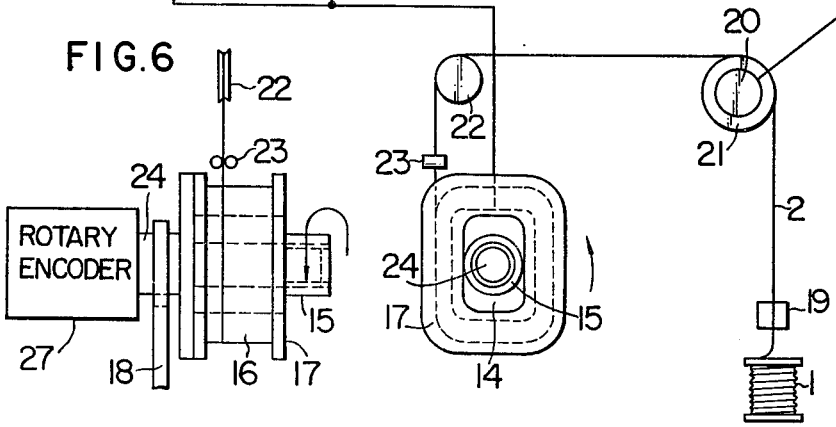
FIG. 6 is a side view to show a portion of the control apparatus shown in FIG. 5.
Figure 8:
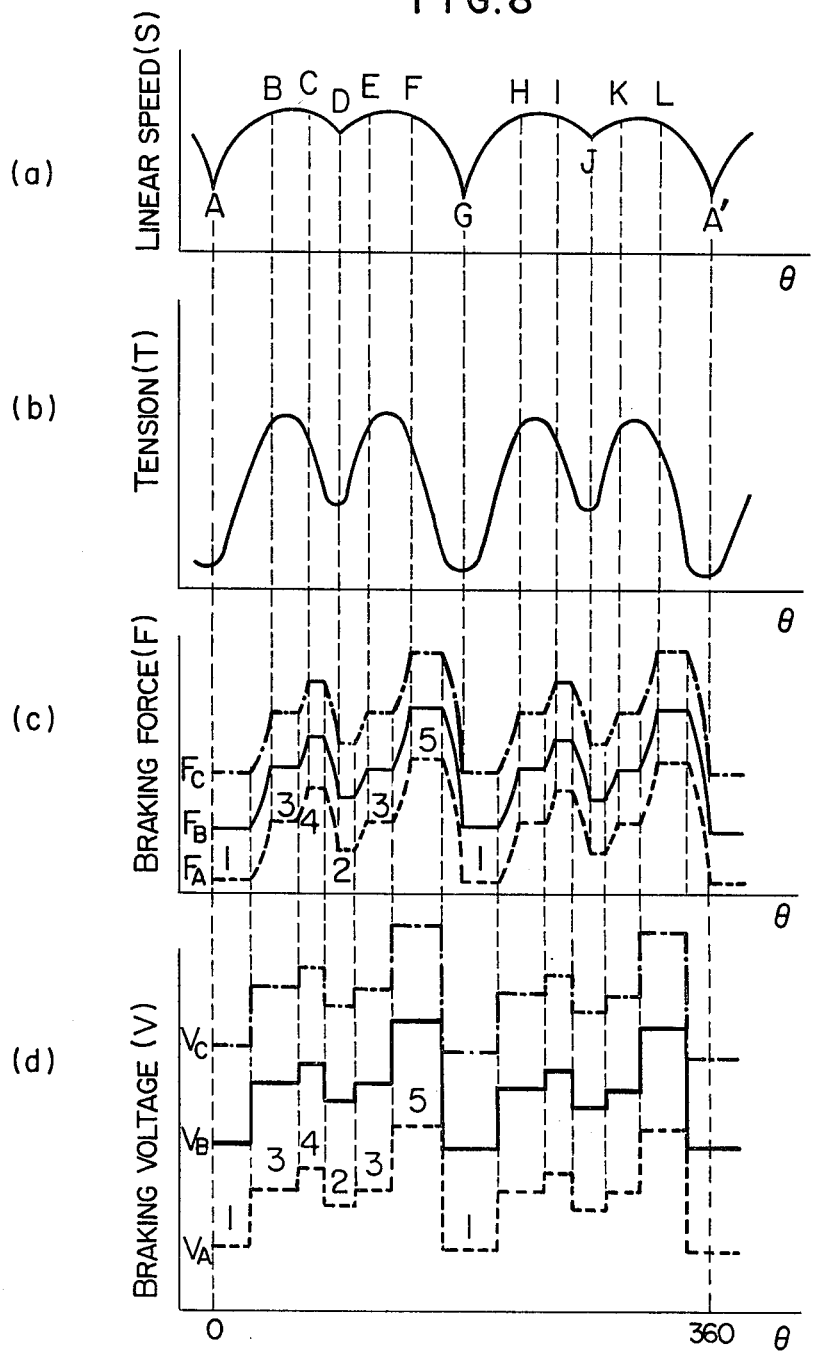
FIG. 8 is a timing diagram to illustrate variations in a feeding speed of an electric wire during a single revolution of a bobbin having a rectangular cross-section together with associated variations in tension of the wire, controlled braking forces corresponding to the variations in tension and brake voltages for producing the controlled braking forces.

In the case of the second embodiment now being described, the linear speed of the electric wire 2 during the winding of a first layer will vary in a manner illustrated by a solid line in FIG. 7 due to the fact that the winding drum portion of the bobbin 17 is of a rectangular cross-section, not of a circular cross-section as in the case of the preceding example. Variations in the linar speed of the electric wire 2 may be divided into a linear acceleration region, a constant speed region, a linear deceleration region (indicated by a double-dotted line curve in FIG. 7) and the variations in the rotation speed which occur during a single complete revolution of the bobbin 17 indicated in FIG. 8 at (a). Accordingly, there are preset in the controller 30 the data of timing for changing over the brake voltages corresponding to the variations in the linear speed of the wire 2 together with data representing the number of turns for a single winding layer and the total number of turns desired for the completed coil. On the other hand, there are loaded in the controller 40 data for changing over the braking forces generated by the electromagnetic brake 20 on the assumption that the braking force applied to the wire 12 is changed at twelve points A, B, C, D, . . . , K and L in correspondence to the changes in the linear speed of the wire 2 occuring during a single complete revolution, as is shown in FIG. 8 at (a). Each command for changing over the braking force is issued at a time point preceding to each of the time points A, B, . . . , K and L by a time span corresponding to the time constant (operation lag) of the electromagnetic brake 20. The bobbin 17 is fittingly mounted on the drum portion 14 of the winding shaft 24 and fixedly secured by means of the clamping nut 15. Then, the free end portion of the electric wire 2 threaded out from the paired transverse rollers 23 is secured to the winding bobbin 26 or the winding shaft 24 at a predetermined location. After the initialization described above, the controller 30 is started to close the switch 34 to thereby apply a brake voltage $V_A$, while the switch 46 is closed under the command of the controller 40 to derive a brake voltage $V_{A1}$ which is applied to the electromagnetic brake 20 after having been amplified through the differential amplifier 37. In response to the brake voltage $V_{A1}$, the electromagnetic brake 20 applies a corresponding braking force $F_{A1}$ to the brake reel 21. In this state, the winding shaft 24 is rotated, while the paired positioning rollers 23 are caused to move synchronously in the direction parallel to the axis of the winding bobbin 17. The bobbin 17 is thus rapidly accelerated in rotation from the initial speed 0 to an increased speed corresponding to a preset number of revolutions. At that time, the rotary encoder 27 produces pulses with a predetermined pulse interval in synchronism with the rotating speed of the bobbin 17, which pulses are supplied to both the counters 28 and 38 to be counted. When the count value in the counter 38 coincides with the data value set at the comparator 39 from the controller 40, a command signal for changing the brake voltage is supplied to the controller 40 from the comparator 39. Then, the comparator 39 is loaded with the succeeding data from the controller 40, and the switch 46 is opened while the switch 48 is simultaneously closed to derive a brake voltage $V_{A3}$ which is now applied to the electromagnetic brake 20 through the differential amplifier 37. In response, the electromagnetic brake 20 produces a braking force $F_{A3}$ corresponding to the brake voltage $V_{A3}$ and applies it to the brake reel 21. When the counted value in the counter 39 coincides with the value set at the comparator 39 upon further rotation of the winding bobbin 17, a brake voltage changing command signal is issued from the comparator 39 to the controller 40 which in turn will then respond to the command signal to load the succeeding data to the comparator 39 and open the switch 48 while closing the switch 49 simultaneously, as the result of which a brake voltage $V_{A4}$ is derived and applied to the electromagnetic brake 20. Consequently, a braking force $F_{A4}$ corresponding to the brake voltage $V_{A4}$ is produced by the electromagnetic brake 20 and applied to the brake reel 21. Upon occurrence of coincidence between the count value in the counter 39 and the value set now at the comparator 39 in the course of further rotation of the bobbin 17, a further brake voltage changing command is issued from the comparator 39 to the controller 40 which then responds thereto to place the next data in the comparator 39 and open the switch 49 while closing the switch 47 simultaneously to derive a brake voltage $V_{A2}$ which is applied to the electromagnetic brake 20. The latter then produces a braking force $F_{A2}$ corresponding to the brake voltage $V_{A2}$. When the counted value in the counter 39 coincides with the data value set now at the comparator 39 upon further rotation of the bobbin 17, another brake voltage changing command is issued again from the comparator 39 to the controller 40, whereupon the controller 40 places the next data to the comparator 39 and opens the switch 47 while closing the switch 48 simultaneously to thereby derive the brake voltage $V_{A3}$ to be applied to the electromagnetic brake 20. Thus, the electromagnetic brake 20 produces the braking force $F_{A3}$ corresponding to the braking voltage $V_{A3}$ and applies it to the brake reel 21. When coincidence occurs between the count value in the counter 39 and the data value set now at the comparator 39 in the course of further rotation of the bobbin 17, a further brake voltage changing command is again supplied to the controller 40 from the comparator 39. The controller 40 responds thereto to load the next data in the comparator 39 and opens the switch 48 while closing the switch 50 simultaneously to derive a brake voltage $V_{A5}$ and applies it to the electromagnetic brake 20. As the consequence, the electromagnetic brake 20 applies a braking force $F_{A5}$ corresponding to the applied brake voltage $V_{A5}$ to the brake reel 21. In this way, the control of tension to which the electric wire 2 is subjected to is effected during a period corresponding to a half of the single complete revolution of the bobbin 17. The controlling process described above is repeated periodically, as the wire 21 is progressively wound around the bobbin 17. When a time point has been attained which precedes immediately to the transition from the mode for accelerating the bobbin 17 to the constant-speed rotation, the value which is contained in the other counter 28 at that instant coincides with the preset value in the other comparator 29, whereupon a brake voltage changing command is supplied from the comparator 29 to the other controller 30. Then, the controller 30 sets next data at the comparator 29 and opens now the switch 34 while closing the switch 35 simultaneously, to thereby derive a brake voltage $V_B$. Accordingly, the brake voltage $V_A$ is changed over to the brake voltage $V_B$ immediately before the transition to the constant-speed rotation of the bobbin 17, whereby the brake voltages $V_{A1}$, $V_{A2}$, $V_{A3}$, $V_{A4}$ and $V_{A5}$ derived from the resistors 41, 42, 43, 44 and 45 will now be replaced by brake voltages $V_{B1}$, $V_{B2}$, $V_{B3}$, $V_{B4}$ and $V_{B5}$ with the braking forces $F_{A1}$, $F_{A2}$, $F_{A3}$, $F_{A4}$ and $F_{A5}$ being changed to braking forces $F_{B1}$, $F_{B2}$, $F_{B3}$, $F_{B4}$ and $F_{B5}$, respectively, as is illustrated in FIG. 8. During the constant-speed rotation of the bobbin 17, the controlling operations are performed in the manner described above, whereby the brake voltages $V_{B1}$ to $V_{B5}$ are successively changed over to one another in the predetermined sequence described above to control the tension under which the electric wire 2 stands during the constant-speed rotation of the bobbin 17. When the winding operation proceeds to a time point immediately before the transition from the constant-speed rotation of the bobbin 17 to the deceleration mode, coincidence will occur between the count value in the counter 28 and the value set at the comparator 29, resulting in a brake voltage changing command supplied from the comparator 29 to the controller 30. The latter will then place next data in the comparator 29 and opens the switch 35 while closing simultaneously the switch 36 to derive a brake voltage $V_C$. In this manner, since the brake voltage $V_B$ is changed over to the brake voltage $V_C$ immediately before decelerating the rotating speed of the bobbin 17, the brake voltages $V_{B1}$, $V_{B2}$, $V_{B3}$, $V_{B4}$ and $V_{B5}$ derived from the resistors 41, 42, 43, 44 and 45, respectively, will be changed over to brake voltages $V_{C1}$, $V_{C2}$, $V_{C3}$, $V_{C4}$ and $V_{C5}$, with the braking forces $F_{B1}$, $F_{B2}$, $F_{B3}$, $F_{B4}$ and $F_{B5}$ being changed correspondingly to braking forces $F_{C1}$, $F_{C2}$, $F_{C3}$, $F_{C4}$ and $F_{C5}$, respectively, as is illustrated in FIG. 8. During the deceleration of the winding bobbin 17, the brake voltages $V_{C1}$ to $V_{C5}$ are changed over to one another successively in the predetermined sequence described above to thereby control correspondingly the tension of the electric wire 2. Further, for changing over the rotation of the bobbin from the decelerating mode to a low constant-speed rotation and thence again to the accelerating mode, the tension of the wire 2 is controlled in a similar manner as described hereinbefore.

In this way, it is possible to maintain the tension applied to the electric wire substantially constant for fabricating a coil of a rectangular cross-section wound in a perfectly aligned condition by controlling variation in tension on the wire 2 as brought about by variation in the rotating speed of the winding bobbin 17 through the controller 30 while controlling the variation in tension on the wire 2 occurring during a single revolution of the bobbin 17 by means of the controller 40.

In the foregoing description made with reference to FIGS. 5 to 8, it has been assumed that variations in tension on the wire occurring during the single revolution of the bobbin 17 are controlled over twelve different intervals or ranges. However, it will be appreciated that the control may be effected in a more finely divided manner. In the case where a microcomputer is employed for the controller 40, the control may be executed in accordance with a similar program as the one illustrated in FIG. 4. Further, both the controllers 30 and 40 may be implemented by a single micro-computer. In such case, the counters 28 and 38 may be constituted by a single counter arranged for a time-sharing use. The same applies to both the comparators 29 and 39. Besides, it is also conceivable to derive the required brake voltage through single stage of the voltage divider resistor circuit by correspondingly increasing the number of resistors (41 to 45) instead of using two stages of the voltage divider circuits described above.

We claim:

1. An apparatus for controlling tension applied onto an electric wire to be wound around a rotatably supported bobbin in a winding machine, comprising detecting means for detecting rotating position of said bobbin, wire winding means adapted to alter the rotating speed of said bobbin in dependence on the output from said detecting means, traverse means disposed movably in a direction parallel to the axis of said bobbin while holding said electric wire in a sandwiched manner to thereby allow said electric wire to be displaced and wound around said bobbin so that said electric wire is wound in perfect alignment with the preceding coil portion wound around said bobbin for forming a perfect layer coil, and electromagnetic brake means including a brake reel around which said electric wire is wound for a predetermined number of turns as dispensed from a supply reel and an electromagnetic brake for applying a brake force to said brake reel thereby to maintain said electric wire under tension, an improvement comprising control means operatively connected to said detecting means and said electromagnetic brake for determining rotational positions of said bobbin which precede respectively to those rotational positions by a magnitude corresponding to a time constant of said electromagnetic brake at which rotating speed of said bobbin is to be changed over among an accelerating rotation mode, decelerating rotation mode and a constant-speed rotation mode and setting brake voltages corresponding to said accelerating rotation mode, said decelerating rotation mode and said constant-speed rotation mode, respectively, wherein upon every occurrence of coincidence between the rotating position of said bobbin detected by said detecting means and the rotating position of said bobbin determined by said control means, the brake voltage corresponding to the succeeding rotation mode to be next established is applied to said electromagnetic brake thereby to produce the braking force corresponding to said succeeding rotation mode upon transition thereto, whereby tension applied to said electric wire is controlled to be substantially constant during the winding operation.

2. An apparatus for controlling tension applied onto an electric wire to be wound around a rotatably supported bobbin in a winding machine, comprising detecting means for detecting rotating position of said bobbin, wire winding means adapted to alter the rotating speed of said bobbin in dependence on the output from said detecting means, traverse means disposed movably in a direction parallel to the axis of said bobbin while holding said electric wire in a sandwiched manner to thereby allow said electric wire to be displaced and wound around said bobbin so that said electric wire is wound in coordinated alignment with the preceding coil portion wound around said bobbin for forming a perfect layer coil, and electromagnetic brake means including a bake reel around which said electric wire is wound for a predetermined number of turns as dispensed from a supply reel and an electromagnetic brake for applying a brake force to said brake reel thereby to maintain said electric wire under tension, an improvement comprising a first controller for determining rotating position of said bobbin which precedes to those rotating positions by a magnitude corresponding to a time constant of said electromagnetic brake at which the rotating speed of said bobbin is to be changed over among an accelerating rotation mode, a decelerating rotation mode and a constant-speed rotation mode and setting brake voltages corresponding, respectively, to said rotation modes, a second controller for determining rotating positions of said bobbin which precedes to those rotating positions thereof by a magnitude corresponding to the time constant of said electromagnetic brake at which variations in tension applied to said electric wire occurs during a single revolution of said bobbin and setting brake voltages corresponding, respectively, to said variations in tension of said electric wire during the single revolution of said bobbin, wherein upon every detection of coincidence between the actual rotating position of said bobbin detected by said detecting means and said rotating position determined by said first controller, the brake voltage corresponding to the succeeding rotation mode to be next established is produced as a source voltage, and upon occurrence of coincidence between the actual rotating position detected by said detecting means and the rotating position predetermined by said second controller, the brake voltage corresponding to the relevant variation in tension of said electric wire is derived from said source voltage and applied to said electromagnetic brake, whereby braking forces corresponding, respectively, to said rotation modes and said variations in tension of said electric wire are produced to control the tension of said electric wire to be substantially constant during the winding operation.

3. An apparatus for controlling tension of an electric wire to be wound into a coil in a winding machine according to claim 1 or 2, further including pretensioning means disposed between said supply reel for the electric wire and said brake means for applying additionally tension to said electric wire to thereby prevent slip from occurring between said electric wire and said brake reel due to variation in a feeding speed of said electric wire.

4. An apparatus according to claim 1, wherein said detecting means detects the rotation angle of said bobbin, and said control means includes calculating means responsive to the output of said detecting means for calculating the number of rotations of said bobbin by counting the rotation angle of said bobbin outputted from said detecting means, comparing means operatively connected to said calculating means, a control device operatively connected to said comparing means and to a plurality of switches for determining the rotational positions of said bobbin which precede, respectively, to those rotational positions by a magnitude corresponding to a time constant of said electromagnetic brake means at which rotating speed of said bobbin is to be changed over among the accelerating rotation mode, decelerating rotation mode and constant-speed rotation mode, said control device setting a program control for selectively operating said plurality of switches in accordance with the rotational positions, a plurality of resistors coupled to a voltage source and associated with said plurality of switches for providing brake voltages corresponding to the respective rotation modes in accordance with the closing of a respective one of said plurality of switches, and amplifying means coupled to said plurality of resistors for amplifying the brake voltage provided in accordance with the rotational mode and for applying the brake voltage to said electromagnetic brake means.

5. An apparatus according to claim 2, wherein said detecting means detects the rotational angle of said bobbin, and said first controller includes first calculating means responsive to the output of said detecting means for calculating the number of rotations of said bobbin by counting the rotation angle of said bobbin outputted from said detecting means, first comparing means operatively connected to said first calculating means, a first control device operatively connected to said first comparing means and to a first group of switches for determining the rotational positions of said bobbin which precede, respectively, to those rotational positions by a magnitude corresponding to a time constant of said electromagnetic brake means at which rotating speed of said bobbin is to be changed over among the accelerating rotation mode, decelerating rotation mode and constant-speed rotation mode, said first control device setting a program control for selectively operating said first group of switches in accordance with the rotational positions, a first group of resistors coupled to a voltage source and associated with said first group of switches for providing brake voltages corresponding to the respective rotation modes in accordance with the closing of a respective one of said first group of switches, said second controller including second calculating means responsive to the output of said detecting means for calculating the rotational position for each single revolution of said bobbin by counting the rotation angle of said bobbin outputted from said detecting means, second comparing means operatively connected to said second calculating means, a second control device operatively connected to said second comparing means and to a second group of switches for determining the rotational position of said bobbin which precedes to those rotational positions at which position the tension of the wire is changed, by a magnitude corresponding to a time constant of said electromagnetic brake means, said second control device setting a program for selectively operating said second group of switches in accordance with the rotational positions, a second group of resistors operatively connected to said first group of switches for outputting a brake voltage corresponding to the change of tension of the wire from the voltage source when the brake voltage applied by closing of said first group of switches serves as the voltage source, and amplifying means operatively connected to said second group of switches for amplifying the brake voltages provided by said second group of resistors in accordance with the closing of respective ones of said second group of switches and for applying the brake voltages to said electromagnetic brake means, wherein when the rotation number of said bobbin calculated by said first calculating means is coincident to the rotational position set by said first control device, respective ones of said first group of switches are closed in accordance with the program of said first control device to output the brake voltage, and further when the rotational position of said bobbin calculated by said second calculating means for each single revolution of said bobbin is coincident with the rotational position set by said second control device at which position the tension of the wire is changed, respective ones of said second group of switches are closed in accordance with the program of said second control device to apply the brake voltage from respective ones of the second group of resistors to said electromagnetic brake means through said amplifier means.

* * * * *